United States Patent [19]

de Vries

[11] 4,435,637

[45] Mar. 6, 1984

[54] APPARATUS FOR HEATING A SHEET- OR WEB-LIKE MATERIAL

[76] Inventor: Jacob de Vries, Insulindeweg 10, 1462 MJ Middenbeemster, Netherlands

[21] Appl. No.: 428,551

[22] Filed: Sep. 30, 1982

Related U.S. Application Data

[63] Continuation of Ser. No. 244,510, Mar. 16, 1981, abandoned, which is a continuation-in-part of Ser. No. 210,382, Nov. 26, 1980.

[30] Foreign Application Priority Data

Apr. 2, 1980 [NL] Netherlands ..... 8001944

[51] Int. Cl.[3] ..... H05B 1/02

[52] U.S. Cl. ..... 219/358; 219/388; 219/497; 219/502; 432/59; 432/227

[58] Field of Search ..... 219/388, 216, 379, 358, 219/497, 492, 500, 502, 505; 432/37, 59, 227, 51; 307/117

[56] References Cited

U.S. PATENT DOCUMENTS

| | | | |
|---|---|---|---|
| 3,558,853 | 1/1971 | Schluntz | 219/388 |
| 3,679,518 | 7/1972 | Andler et al. | 219/492 |
| 4,032,817 | 6/1977 | Richmond | 315/149 |
| 4,049,947 | 9/1977 | Bestenreiner et al. | 219/216 |
| 4,228,345 | 10/1980 | Stricker et al. | 219/388 |
| 4,366,369 | 12/1982 | Hagen et al. | 219/388 |

*Primary Examiner*—M. H. Paschall

*Attorney, Agent, or Firm*—Kane, Dalsimer, Kane, Sullivan and Kurucz

[57] ABSTRACT

An apparatus for heating a sheet- or web-like material during its transport through a processing machine, comprises at least one infrared heating panel facing the path of transport of the material. The apparatus is provided with a controlling circuit for controlling the heat emission of the heating panel in response to a control signal generated by a control means. The heating panel is switched off if the transport speed of the material becomes smaller than a minimum speed by means of a monitoring circuit which can switch off the controlling circuit, said monitoring circuit being coupled to a detector means reacting to the transport speed. The monitoring circuit may further comprise at least one zone detector means reacting to the presence of the material within a given zone extending transversely to the transport direction of the material on either side of the desired path of transport, wherein the monitoring circuit switches off the controlling circuit if the material leaves the zone.

7 Claims, 13 Drawing Figures

APPARATUS FOR HEATING A SHEET- OR WEB-LIKE MATERIAL

CROSS REFERENCE TO RELATED APPLICATIONS

This is a continuation of Ser. No. 244,510 filed Mar. 16, 1981, now abandoned which was a continuation-in-part of Ser. No. 210,382 filed Nov. 26, 1980.

BACKGROUND OF THE INVENTION

The invention relates to an apparatus for heating a sheet- or web-like material during its transport through a processing machine, comprising at least one infrared heating panel facing the path of transport of the material and connected to an ac-source through semiconductor switching means, a controlling circuit for delivering ignition impulses to the semiconductor switching means, wherein the ignition time within each half period of the supply voltage is determined by a control signal provided by a control means to the controlling circuit, while the heating panel is switched off if the transport speed of the material becomes smaller than a minimum speed.

SUMMARY OF THE INVENTION.

It is an object of the invention to provide an apparatus of this type, wherein the switching off of the heating panel for preventing fire or unnecessary power consumption is realized in a very simple manner.

To this end, the apparatus according to the invention is characterized in that said controlling circuit can be switched off by a monitoring circuit coupled to a detector means reacting to the transport speed.

Preferably, said monitoring circuit comprises at least one zone detector means reacting to the presence of the material within a given zone extending transversely to the transport direction of the material on either side of the desired path of transport, wherein the monitoring circuit switches off the controlling circuit if the material leaves said zone. In this manner a timely switching off of the heating panel can be realized at failures of the processing machine causing the web tension of the web-like material to drop out without the transport speed immediately decreasing.

BRIEF DESCRIPTION OF THE DRAWINGS

The invention will hereinafter be explained in further detail by reference to the drawings, in which some embodiments of the apparatus according to the invention are shown.

DETAILED DESCRIPTION OF THE PREFERRED EMBODIMENTS

Figure 1:
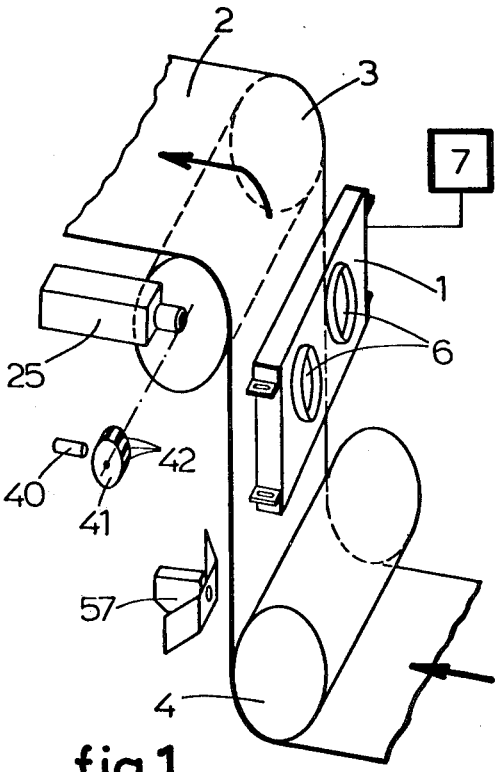
FIG. 1 schematically shows the arrangement of a heating panel of the apparatus according to the invention with respect to a web-like material.
Figure 2:
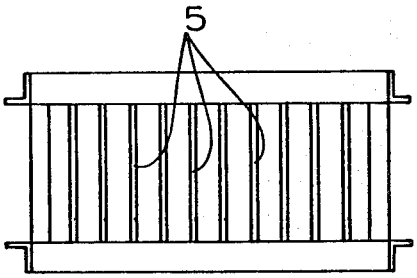
FIG. 2 is a front view of the heating panel of FIG. 1.

FIG. 1 schematically shows the arrangement of a heating panel 1 of an apparatus for heating a material web 2 which is passed through a processing machine, such as, for instance, a printing press. Only two guide rollers 3,4 of the processing machine are shown in FIG. 1. The heating panel 1 is equipped with a plurality of infrared elements 5 (see FIG. 2), which are provided in the form of infrared quartz tubes. Because of the elevated temperature (2100° C.) of the tungsten filament of these quartz tubes, the infrared elements 5 provide short- to medium-wave infrared radiation (1000 to 3000 nm), which offers major advantages.

First of all, the infrared elements 5 have a low thermal inertia, so that, if required, the maximum heat emission is available about 0.5 s after switching on the heating panel 1, while there is no longer any heat emission as early as about 0.2 s after switching off the heating panel 1. Further, virtually no heat is released to the layer of air between the heating panel 1 and the web 2, so that the efficiency is high. Moreover, the short-wave infrared radiation penetrates deeply into the web 2, so that there is optimum heating of the material. In the case of a rotary offset machine, wherein a suitable ink is used, drying of the ink is thus introduced, causing the quality and the processability of the web 2 following the printing operation to be substantially improved.

Finally, the heating panel 1 is provided with two blowers 6 for cooling the terminal connections of the infrared elements 5.

The heat emission of the heating panel 1 is determined by a controlling unit 7 in response to a control signal provided by a control means, as will be explained hereinafter. To this end, the controlling unit 7 comprises a plurality of thyristors, which are indicated schematically in FIGS. 3,4 and by a block 8 and are included in the power supply lines of the infrared elements 5. Further, the controlling unit 7 comprises a controlling circuit 9 for delivering ignition impulses to the gate electrodes 10 of the thyristors 8. The time of ignition of the thyristors 8 with respect to the zero passages of the supply voltage is determined by the magnitude of the control signal.

Figure 6:
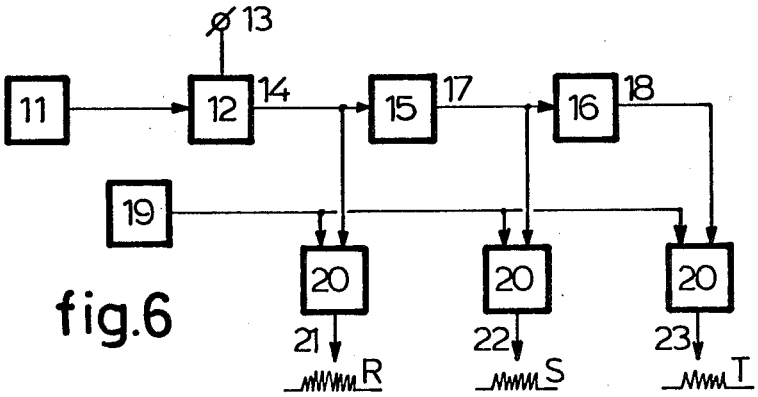
FIG. 6 is a block diagram of the controlling unit used with the apparatus of FIG. 1 through 5.

As shown in FIG. 6, the controlling circuit 9 is provided with a detector 11, which at each zero passage delivers an impulse to a timing circuit 12, an input 13 of which receives the control signal. The control signal, the magnitude of which can vary from 0 to 5 V, determines within each half period of the supply voltage the time with respect to the zero passages at which an output impulse with a predetermined duration appears at an output 14 ot the timing circuit 12. Since a varying of the heat emission of the heating panel 1 from 30 to 100 percent of the maximum heat emission is sufficient, the output 14 of the timing circuit 12 delivers, at a control signal of 0 V, an output impulse at such a time that the heating panel 1 delivers about 30 percent of the maximum heat emission.

According to the embodiment described, the infrared elements 5 are connected groupwise to a three-phase ac-source, so that three successive ignition impulses are necessary. The first ignition impulse is formed by the output impulse of the timing circuit 12. The next two ignition impulses are obtained by means of two delay means 15 and 16, which are series-connected to the output 14, and the outputs 17 and 18 of which provide the second and the third ignition impulse, respectively. In order to ensure a reliable ignition for the respective thyristors 8, the ignition impulses are each converted with the aid of an oscillator 19 and three mixing circuits 20 into a series of ignition impulses, which impulse series appear respectively at outputs 21, 22 and 23, as indicated in FIG. 6. These outputs 21–23 are coupled in a suitable manner to the gate electrodes 10 of the thyristors 8.

Figure 3:
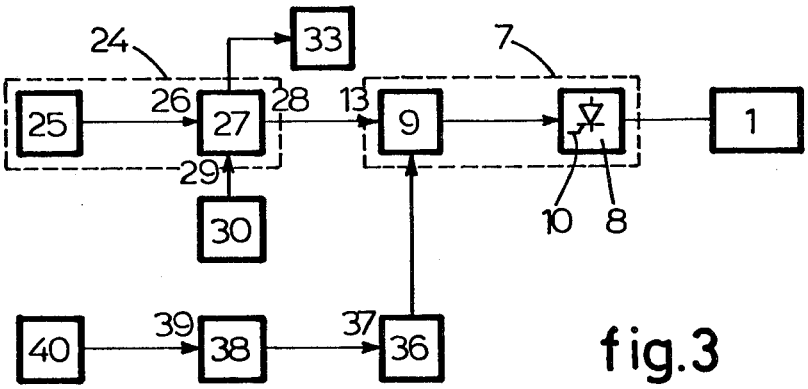
FIG. 3 is a block diagram of an embodiment of the apparatus according to the invention, wherein the heat emission is a function of the temperature of the material.

FIG. 3 shows an embodiment of the apparatus according to the invention wherein the control signal is a function of the temperature of the web 2. In this case the control means 24, which applies the control signal to the input 13 of the controlling circuit 9, comprises a temperature detector 25 which, in the transportdirection of the web 2 is mounted beyond the heating panel 1, as shown in FIG. 1. The temperature detector 25, which may be, for example, an optical pyrometer, delivers an output signal which is proportional to the temperature of the passing web 2.

The temperature detector 25 is connected to an input of a control circuit 27, an output 28 of which delivers the control signal which is inversely proportional to the temperature of the web 2. The control circuit 27 has a second input 29, to which a manually operable adjusting device 30 is connected for adjusting the desired temperature of the web 2.

Figure 7:
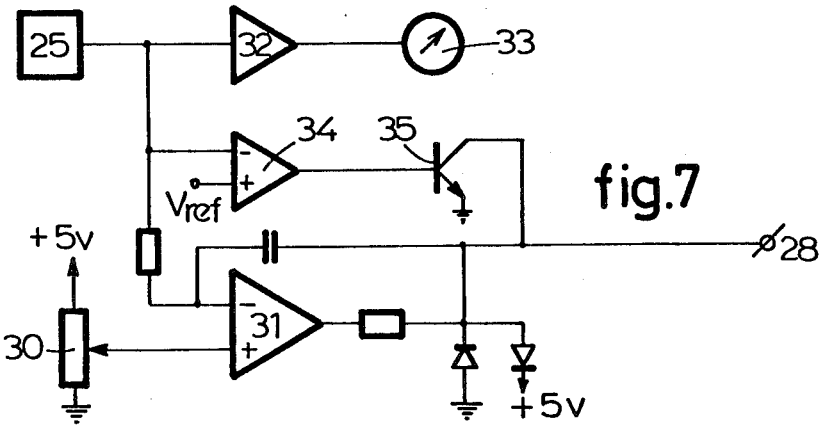
FIG. 7 is a block diagram of a part of the apparatus of FIG. 3.

According to FIG. 7, which shows the control circuit 27 in more detail, the adjusting device 30, provided in the form of a potentiometer is connected to the non-inverting input of an operational amplifier 31, which is connected as an integrator and the inverting input of which is coupled to the temperature detector 25. The output of the amplifier 31 delivers the control signal and forms the output 28 of the control circuit 27. As the output signal of the temperature detector 25 increases, i.e., at rising temperature, the magnitude of the control signal at the output 28 will decrease, and therefore the heat emission of the heating panel 1 as well, and conversely. In this manner, an equilibrium is reached at a temperature determined by the adjustment of the potentiometer 30.

Further, the output signal of the temperature detector 25 is applied to an amplifier 32, to which an indicator 33 is connected which indicates the prevailing temperature of the web 2. The control circuit 27 further comprises a comparator 34 for comparing the output signal of the temperature detector 25 with a fixed reference value, which corresponds to a given minimum temperature. When the temperature output signal drops below this reference value, the comparator 34 turns on a transistor 35 causing the output 28 to be short-circuited and the control signal to be fixed at the value zero. As a result, a failure—produced, for example, by a wire rupture or the like—does not have the effect of the heating panel 1 becoming completely energized, since there would otherwise be the possibility of fire breaking out.

In the embodiment shown in FIG. 3, a monitoring circuit 36 is provided for switching off or disconnecting the controlling circuit 9 when the transport speed of the web 2 drops below a given value. The controlling circuit 9 then can no longer supply any ignition impulses to the thyristors 8, so that the heating panel 1 no longer emits any heat. Accordingly, energy savings can be obtained while the web 2 is being passed at a low running speed through the processing machine, and an impermissible increase in temperature of the material is prevented when the web 2 is brought to a rapid standstill.

An input 37 of the monitoring circuit 36 receives a control voltage from a converter 38, an input 39 of which is connected to a detector 40. The detector 40, provided in the form of an inductive transducer, cooperates with a round disc 41 which is coupled with the guide roller 3 and has a number of schematically indicated metallic projections 42 uniformly distributed on the periphery thereof. The sensor 40 thus supplies an impulse signal, the frequency of which corresponds to the transport speed of the web 2. The convertor 38 converts this impulse signal into the aforementioned control voltage. The converter 38 and the monitoring circuit 36 will be further explained hereinafter.

Figure 4:
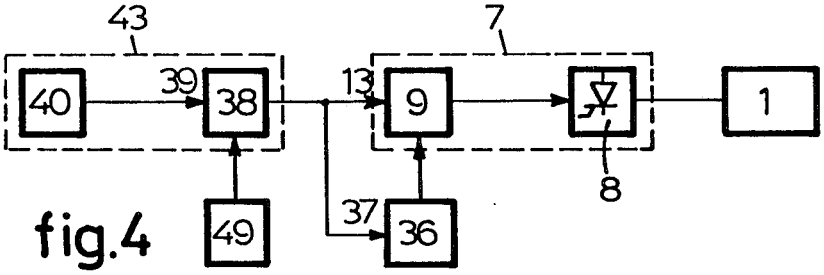
FIG. 4 is a block diagram of an embodiment of the apparatus according to the invention, wherein the heat emission of the heating panel is a function of the transport speed of the material.

FIG. 4 shows an embodiment of the apparatus according to the invention which is likewise equipped with the controlling unit 7, but wherein the control signal supplied at the input 13 is a function of the transport speed of the web 2. In this case, control means 43 is constituted by the detector 40 and by the converter 38 acting as a control circuit, the output voltage delivered by the converter 38 being used as the control signal. Just as in the embodiment of FIG. 3, use is made of the monitoring circuit 36, the input 37 of which likewise receives the output voltage of the converter 38.

Figure 8:
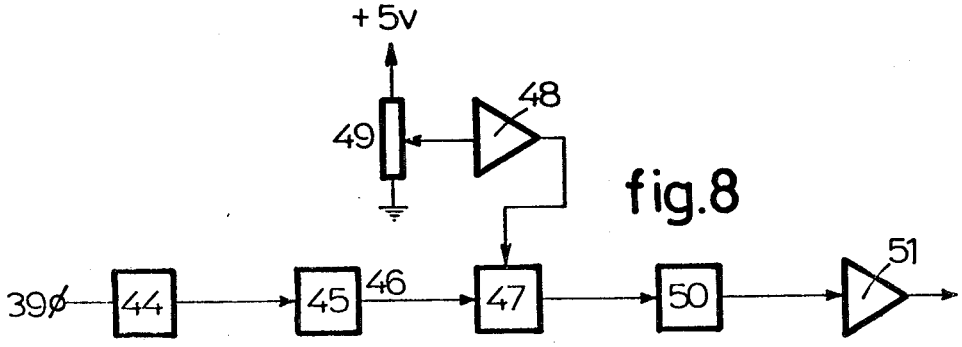
FIG. 8 is a block diagram of a part of the apparatus of FIGS. 3 and 4.

The converter 38, more details of which are shown in FIG. 8, receives at the input 39 the impulse signal of the detector 40, which signal is converted by means of a Schmitt trigger 44 and a monostable multivibrator 45 into impulses having a predetermined duration T. These impulses appear at an output 46 of the multivibrator 45 and control an analogue multiplexer 47, the analogue input of which is connected to the output of a buffer amplifier 48. This buffer amplifier 48 provides an output voltage which can be adjusted by means of a potentiometer 49. Impulses thus appear at the output of the multiplexer 47, which correspond in duration to the duration of the output impulses of the multi-vibrator 45, while the amplitude is determined by the adjustment of the potentiometer 49. The output of the multiplexer 47 is connected to a low-pass filter 50, which supplies an output dc-voltage, the magnitude of which is a function of the frequency and the amplitude of the impulses received. Finally, an amplifier 51 is provided with which the dc-voltage is brought to the desired level for the control signal.

From the above it will be understood that the converter 38 provides an output voltage, the magnitude of which is a function of the frequency of the impulse signal delivered by the detector 40, as well as of the adjustment of the potentiometer 49. The supplied output voltage which constitutes the control signal varies between 0 and 5 V. The potentiometer 49 allows adjustment of the rate of increase of the control signal and, therefore, of the heat emission of the heating panel 1 at increasing transport speed, by which the transport speed at which the heating panel 1 emits the maximum amount of heat is also adjusted. If desired, the potentiometer 49 can be adjusted in such manner that, at the maximum transport speed within the control range of the converter 38, the heat emission by the heating panel does not constitute the maximum value which can be reached.

The frequency of the impulse signal of the detector 40 must not exceed a predetermined value. For, no new impulse from the detector 40 must be received within the impulse duration T of the impulses generated by the multivibrator 45. This maximum frequency determines the control range of the converter 38. Of course, the control range of the converter 38 can be adapted in a simple manner to the working speed of the processing machine at which the apparatus according to the invention is used. This can be achieved, for example, by choosing a suitable number of metallic projections 42 of the disc 41.

Figure 9:
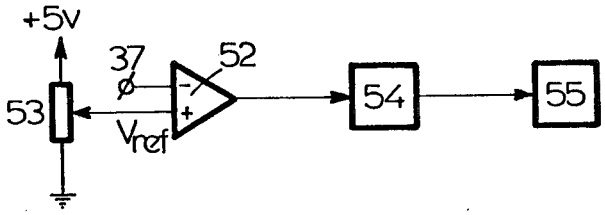
FIG. 9 is a block diagram of the monitoring circuit used with the apparatus of FIGS. 1 through 4.

As already noted, the output of the converter 38 is also connected to the input 37 of the monitoring circuit 36, which is shown in FIG. 9. The monitoring circuit 36 is provided with a comparator 52, the inverting input of which receives the output voltage of the converter 38, while a reference voltage $V_{ref}$, adjustable by means of a potentiometer 53, is connected to the non-inverting input. The comparator 52 is connected by a time-delay means 54—which is active only when the output of the comparator 52 changes from the high to the low level—to a switching element 55, with which the controlling circuit 9 can be switched on and off, for example by interrupting the supply voltage for this controlling circuit 9.

When the output voltage of the converter 37 is greater than $V_{ref}$, the output of the comparator 52 is at the low level, and the switching element 55 keeps the controlling circuit 9 switched on, so that the heat emission of the heating panel 1 is controlled in the desired manner. When the transport speed of the web 2 drops below the reference value $V_{ref}$ as adjusted with the potentiometer 53, the output of the comparator 52 changes to the high level, and the switching element 55 at once switches off the controlling circuit 9, so that the heat emission is discontinued. As soon as the transport speed again exceeds the adjusted reference value $V_{ref}$, the output of the comparator 52 changes from the high to the low level, which change of level is transmitted by the time-delay means 54 with some delay to the switching element 55, so that the controlling circuit 9 and therefore the heating panel 1 are switched on with some delay. The time-delay element 54 prevents that the controlling circuit 9 is switched on under the action of interferencence impulses.

Figure 5:
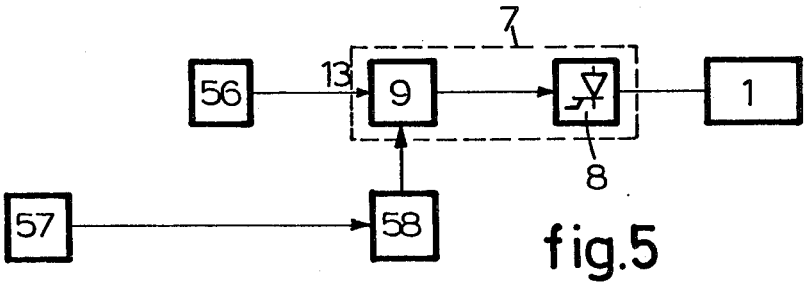
FIG. 5 is a block diagram of an embodiment of the apparatus according to the invention, wherein the heat emission of the heating panel is manually adjustable.

FIG. 5 illustrates a simple embodiment of the apparatus according to the invention, which is particularly suitable for use with a machine for processing sheet-like materials, such as, for example, a sheet-fed offset machine. The control signal, supplied to the input 13 of the controlling unit 7, in this case originates from a manually operable adjusting device 56, which may be constituted, for example, by a potentiometer or by a multiple-position switch.

In this embodiment, a detector 57 provided just before the heating panel 1, viewed in the transport direction of the material, emits a low-level signal in the presence of a sheet, and a high-level signal in the absence of a sheet. This binary signal is supplied to a monitoring circuit 58, which can switch on and off the controlling circuit 9 of the controlling unit 7.

Figure 10:
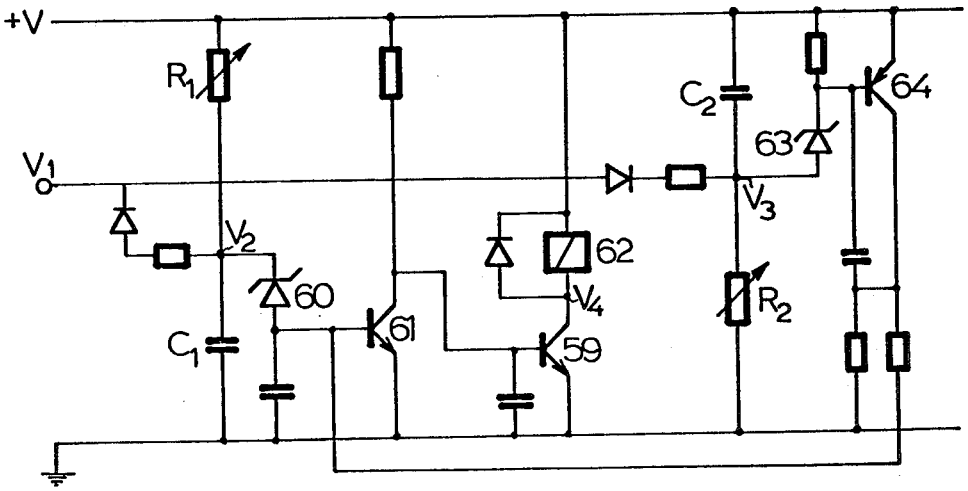
FIG. 10 is a simplified diagram of the monitoring circuit used with the apparatus of FIG. 5.

The monitoring circuit 58 (see FIG. 10) comprises two RC-circuits $R_1C_1$ and $R_2C_2$, by means of which it is established whether the binary signal of the detector 57 has the low or the high level, respectively, for too long a period of time. In the former case, there is a sheet in front of the detector 57 and, therefore, in front of the heating panel 1 as well, while the processing machine is at a standstill or at least is transporting the material at a speed which is too low. The heating panel 1 is then switched off so as to prevent the material from overheating, which could cause fire to break out. In the latter case, no successive sheet appears within the period determined by the time constant $R_1C_1$, and the heating panel 1 is switched off in order to avoid unnecessary energy consumption.

Figure 11:
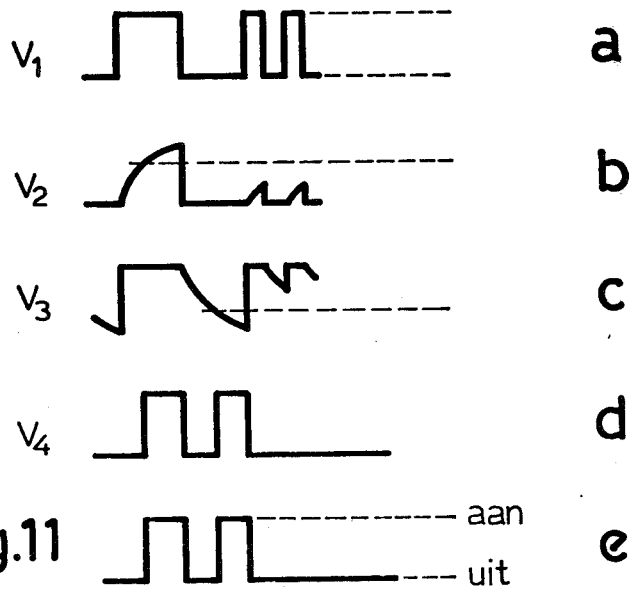
FIG. 11 shows some voltages which can occur in the monitoring circuit of FIG. 10.

Shown in FIG. 11, a–e, are the voltages $V_1$, $V_2$, $V_3$ and $V_4$ occuring in the monitoring circuit 58 and the switching state of the controlling circuit 9 and, therefore, of the heating panel 1. The voltage $V_1$ corresponds to the output signal of the detector 57, while $V_2$ is the voltage on the capacitor $C_1$, and $V_3$ the voltage on the capacitor $C_2$. $V_4$ is the collector voltage of the transistor 59.

The resistances $R_1$ and $R_2$ are adjustable, so that the respective time constants $R_1C_1$ and $R_2C_2$ can be adapted as required.

The operation of the monitoring circuit 58 is as follows:

If no sheet of material is observed for some time by the detector 57, the voltage $V_2$ on the capacitor $C_1$ increases until a zener diode 60 turns on, which causes the transistor 61 to turn on as well. The voltage level at which this takes place is indicated with a broken line in FIG. 11*b*. This causes the transistor 50 to be switched off and a relay 62 connected in the collector line to become inoperative, by which the controlling circuit 9 is switched off.

If a new sheet of material follows before the zener diode 60 turns on, the transistor 59 remains in the conducting state, and the controlling circuit 9 is not switched off.

The voltage $V_1$ has a low value when the detector 57 observes a sheet. As a result, the voltage $V_3$ can decrease, so that, upon reaching a value indicated by a broken line in FIG. 11*c*, a zener diode 63 turns on, which causes a transistor 64 to turn on. As a result, the transistor 61 becomes conductive and the transistor 59 is switched off, so that the relay 62 again becomes inoperative and the controlling circuit 9 is switched off.

If the sheet has passed before the zener diode 63 turns on, the transistor 59 remains conductive, and the controlling circuit 9 is not switched off.

From the above it appears that with the use of the apparatus according to FIG. 5 a favourable energy consumption can be realized in the processing of sheet-like materials with the heating panel 1 emitting heat only when material occurs in front of the heating panel. Furthermore, overheating of the material during standstill or a very low transport speed is prevented, since the heating panel is timely switched off.

Figure 12:
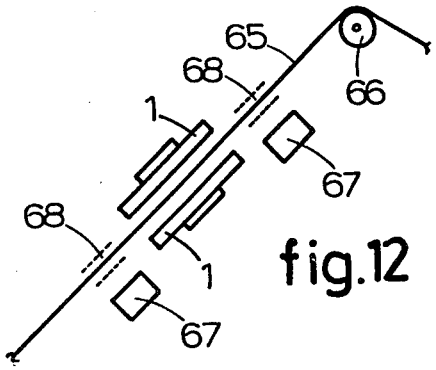
FIG. 12 schematically shows the arrangement of two zone detector means on both sides of two heating panels arranged opposite each other.

FIG. 12 schematically shows the arrangement of two heating panels on both sides of a material web 65, which arrangement may be used in a rotary offset press for example.

The material web 65 only partial shown is guided in tensioned condition between the heating panels 1 and extends along a roller 66 to a folder, for example (not shown in FIG. 12). The control of the heat emission of the heating panels 1, not shown in FIG. 11, can be as a function of the temperature of the material web 65 (FIG. 3) or as a function of the transport speed of the material web 65 (FIG. 4), as desired.

Although with both control methods the heating panels 1 are automatically switched off by the monitoring circuit 36 if the transport speed of the web 65 becomes smaller than the adjusted minimum speed, it could occur under circumstances, for example at a failure of the folder, that, because of a dropout of the web tension, the web 65 contacts a heating panel 1, which is still operating because the transport speed is not yet smaller than the adjusted minimum speed. In this case fire could easily break out.

Figure 13:
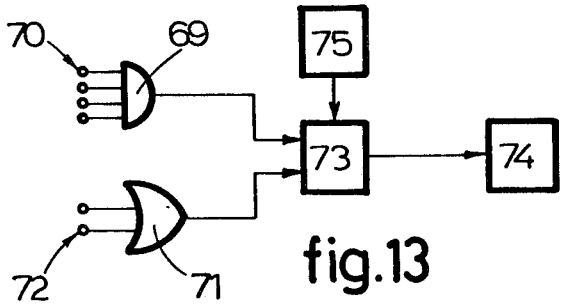
FIG. 13 is a block diagram of a part of the monitoring circuit, to which the zone detector means of FIG. 12 are connected.

According to the invention this disadvantage can be obviated by means of a plurality of detectors 67 connected to a part of the monitory circuit 36 shown in FIG. 13. At the arrangement of FIG. 12 a detector 67 is mounted on both sides of the heating panels 1. The detectors 67 known per se provide a binary signal having the first binary value at the presence of the web 65 within a zone 68 shown by a dotted line on either side of the desired path of transport of the web (shown by the web 65) and the other binary value at the absence of the web 65 in the zone 68.

According to FIG. 13 the monitoring circuit 36 comprises an AND-input circuit 69 with four inputs 70 and a OR-input 71 with two inputs 72, to which inputs 70, 72 the detectors 67 can be connected. The outputs of both input circuits 69, 71 are coupled with a time-delay means 73 which supplies a change of state of the output signal of the input circuits 69, 71 after lapse of a time-delay to a switching means 74 if no new change of state occurs within the time-delay. The switching means 74 can switch on and off the controlling circuit 9 and, therefore, the heating panels 1 in response to the signal supplied by the time-delay means 73.

The time-delay of the time-delay means 73 is adjustable by means of a manually operated adjusting device 75. The time-delay means 73 prevents that short during movements of the web 65 beyond the zone 68 could cause a switching off of the heating panels 1.

If the detectors 67 are connected to the inputs 70 of the AND-input circuit 69 the heating panels 1 are switched off when the web 65 is outside of the zone 68 at one of the detectors 67, while, if the detectors 67 are connected to the inputs 72 of the OR-input circuit 71, the heating panels 1 are switched off when the web 65 is outside of the zone 68 at all detectors 67.

It is noted that both input circuits can have a different plurality of inputs 70, 72 respectively, than shown in FIG. 13.

The detectors 67 also detect an eventual rupture of the web 65 and the complete absence of the web 65.

The invention is not restricted to the embodiments described above, which can be varied in a number of ways within the scope of the invention.

I claim:

1. Apparatus for heating a sheet- or web-like material during its transport through a processing machine, comprising at least one infrared heating panel facing the path of transport of the material and connected to an ac-source through a semiconductor switching means, a controlling circuit for delivering ignition impulses to the semiconductor switching means, wherein the ignition time within each half period of the supply voltage is determined by a control signal provided by a control means to the controlling circuit, which can be switched on and off by a monitoring circuit coupled to a detector means reacting to the transport speed, wherein said monitoring circuit comprises two or more zone detector means reacting to the presence of the material within a given zone extending transversely to the transport direction of the material on either side of the desired path of transport, and an AND-input circuit and/or an OR-input circuit, said input circuits controlling a switching means through a time-delay means for switching the controlling circuit on and off, wherein the controlling circuit is switched off if the material leaves said zone.

2. Apparatus according to claim 1, wherein the time-delay of said time-delay means is adjustable.

3. Apparatus according to claim 1, wherein the monitoring circuit will switch off the heating panel if the rate of passage of the web-like material through the processing machine becomes less than a reference rate and before it comes to a stop.

4. Apparatus according to claim 3, wherein the monitoring circuit includes a first time-delay means which switches on the controlling circuit when a given length of time has lapsed since the transport speed has exceeded the reference rate.

5. Apparatus according to claim 3 or 4 wherein the monitoring circuit includes an adjusting device for adjusting the reference rate at which the controlling circuit is switched off.

6. Apparatus for processing sheet-like material during its transport through a processing machine, comprising at least one infrared heating panel facing the path of transport of the material and connected to an ac-source through a semiconductor switching means, a controlling circuit for delivering ignition impulses to the semiconductor switching means, wherein the ignition time within each half period of the supply voltage is determined by a control signal provided by a control means to the controlling circuit, wherein said controlling circuit can be switched off by a monitoring circuit coupled to a detector means, said detector means being mounted, seen in the transport direction, just before the heating panel and provides a binary signal having the first binary value at the presence of a material sheet opposite the detector means and having the second binary value at the absence of a material sheet opposite the detector means, wherein the monitoring circuit, in response to said binary signal, switches on the controlling circuit at the presence of a material sheet and switches off the controlling circuit if within a first predetermined period after the passage of a material sheet no subsequent sheet is detected by said detector means, wherein the monitoring circuit also switches off the controlling circuit if a material sheet remains longer than a second predetermined period opposite the detector means.

7. Apparatus according to claim 6, wherein both said periods are adjustable.

* * * * *